US006722857B1

(12) United States Patent
Kellner et al.

(10) Patent No.: US 6,722,857 B1
(45) Date of Patent: Apr. 20, 2004

(54) PUMP ASSEMBLY FOR FUEL

(75) Inventors: Andreas Kellner, Moeglingen (DE); Juergen Hammer, Fellbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/009,188

(22) PCT Filed: May 24, 2000

(86) PCT No.: PCT/DE00/01672

§ 371 (c)(1),
(2), (4) Date: May 31, 2002

(87) PCT Pub. No.: WO00/77389

PCT Pub. Date: Dec. 21, 2000

(30) Foreign Application Priority Data

Jun. 9, 1999 (DE) ..... 199 26 308

(51) Int. Cl.[7] ..... F04B 25/00; F04B 3/00; F04B 5/00

(52) U.S. Cl. ..... 417/255; 123/446

(58) Field of Search ..... 417/255, 441, 417/307, 283; 123/299, 300, 506, 446, 495, 510, 514

(56) References Cited

U.S. PATENT DOCUMENTS 4,273,090 A * 6/1981 Hofer et al. ..... 123/502
5,325,837 A * 7/1994 Laufer ..... 123/506
5,431,142 A * 7/1995 Bonse ..... 123/450
5,537,980 A * 7/1996 Yamamoto ..... 123/447
5,626,114 A 5/1997 Kushida et al. ..... 123/198
6,016,786 A * 1/2000 Rodriquez-Amaya et al. ..... 123/299
6,129,518 A * 10/2000 Ricco ..... 417/206
6,135,090 A * 10/2000 Kawachi et al. ..... 123/446
6,196,191 B1 * 3/2001 Rembold et al. ..... 123/447

FOREIGN PATENT DOCUMENTS

DE 25 51 826 A 5/1977 ..... F04B/1/10
DE 35 04 265 A 8/1986 ..... F02M/59/36
DE 197 42 180 A 3/1999 ..... F02M/37/06
DE 198 01 355 A 7/1999 ..... F02M/59/06
DE 198 27 926 A 7/1999 ..... F04B/1/04

* cited by examiner

*Primary Examiner*—Justine R. Yu
*Assistant Examiner*—Han L Liu
(74) *Attorney, Agent, or Firm*—Ronald E. Greigg

(57) ABSTRACT

A pump assembly having a main pump and a prefeed pump which pumps fuel out of a tank. The fuel is pumped through a crank chamber of the main pump. Downstream of the crank chamber f the main pump a return line is provided for the portion of the fuel which is used as lubricant to return to the tank. Also downstream of the crank chamber feed course directs fuel to a metering unit and on to the main pump. To make the pump assembly as simply as possible the prefeed pump is mechanically driven, and a zero-feed course branches off between the metering unit and the main feed pump to return fuel to the intake side of the prefeed pump. A throttle is disposed in the zero-feed course.

16 Claims, 2 Drawing Sheets

PUMP ASSEMBLY FOR FUEL

CROSS-REFERENCE TO RELATED APPLICATIONS

This application is a 35 USC 371 application of PCT/DE 00/01672 filed May 24, 2000.

BACKGROUND OF THE INVENTION

1. Field of the Invention

The present invention relates to a pump assembly for fuel, having a main feed pump and a preceding prefeed pump, which pumps a fuel flow via a fuel line out of a tank and the pumped total fuel flow through a drive/crank chamber of the main feed pump, wherein downstream of the drive/crank chamber in terms of the flow direction of the total fuel flow, a return line for the lubricant flow to the tank and a feed course for the pumping flow to a metering unit and on to the main feed pump are provided.

2. Description of the Prior Art

A pump assembly as described above is known for instance from German Patent Application 198 01 355. In it, a pump assembly for fuel is disclosed which has a main feed pump, embodied as a high-pressure pump, and a preceding prefeed pump. The prefeed pump is embodied as an electric fuel pump and pumps a fuel flow out of a tank via a fuel line. The pumped total fuel flow is carried through the drive/crank chamber of the main feed pump. Downstream of the drive/crank chamber, the total fuel flow is split into a lubricant flow and a pumping flow. The lubricant flow returns to the tank via a return line. The pumping flow, via a feed course, first reaches a metering unit and then goes on to reach the main feed pump.

The main feed pump has at least one pump cylinder, which defines a pump chamber in which a piston is guided so that it can reciprocate. By the reciprocation of the piston, in a so-called intake stroke, the pumping flow is aspirated into the pump chamber, and in an ensuing pumping stroke, the fuel located in the pump chamber is compressed and pumped for instance into a storage volume of a common rail injection system.

To effect the reciprocation of the pump in the pump chamber, the main feed pump of the known pump assembly also has drive means, embodied for instance as a drive shaft. The drive means rotate or move at high speeds within a so-called drive or crank chamber. Upon the rotation or motion of the drive means in the drive/crank chamber, a major thermal and/or mechanical load occurs in this region. The total fuel flow pumped by the prefeed pump is therefore carried entirely through the drive/crank chamber of the pump assembly. Because of the high fuel throughput in the region of the drive/crank chamber, especially good lubrication and major heat dissipation are made possible. In particular, forced lubrication of the drive/crank chamber is also possible, since the total fuel flow is present at the full pumping pressure of the prefeed pump in the drive/crank chamber.

SUMMARY AND OBJECTS OF THE INVENTION

The object of the present invention is to improve a pump assembly of the type recited at the outset, and in particular to create a pump assembly which is especially simple and sturdy in design and functions especially reliably.

To attain this object, the invention, based on the pump assembly of the type recited at the outset, proposes that the prefeed pump is mechanically driven, and that between the metering unit and the main feed pump, a zero-feed course branches off, in which a zero-feed throttle is disposed and which discharges into the fuel line on the intake side of the prefeed pump.

In the pump assembly of the invention, the prefeed pump is embodied as a mechanically driven pump of especially simple and sturdy design. However, first, the pump assembly has to be adapted to an insert of a mechanically driven prefeed pump. For this reason, the pump assembly of the invention has a zero-feed course, which branches off between the metering unit and the main feed pump, or in other words on the intake side of the main feed pump, and discharges into the fuel line upstream of the prefeed pump, that is, on the intake side of the prefeed pump. A zero-feed throttle is disposed in the zero-feed course, in order to limit a zero pumping flow to a certain flow rate. It is conceivable for the zero-feed course to discharge into the tank instead of into the fuel line. However, if a filter is disposed between the tank and the prefeed pump, then the zero-feed course should discharge into the fuel line between the filter and the prefeed pump.

In an advantageous refinement of the present invention, it is proposed that the prefeed pump is embodied as a gear pump. A gear pump is especially simple in design, functions reliably, and has especially high efficiency. For use in the hydraulics of motor vehicles, gear pumps are especially highly suitable. In the pump assembly of the invention, however, piston pumps, vane cell pumps, roller cell pumps, or other pumps can also be used as the prefeed pump.

In a preferred embodiment of the present invention, a check valve and a throttle are disposed one after the other in the return line.

Advantageously, parallel to the return line, a further return line, in which a venting throttle is disposed, is provided. The further return line is embodied for instance as a venting bore with a certain throttle cross section. If the pump assembly of the invention is used to pump fuel for an internal combustion engine of a motor vehicle, then because of the further return line, restarting the engine after the tank has been emptied is possible without any problems. The further return line also branches off downstream of the drive/crank chamber of the main feed pump, in the flow direction of the total flow and also discharges into the tank. The return line and the further return line can also be embodied as a common return line, in which the venting throttle on the one hand and the check valve and the throttle on the other are disposed parallel to one another.

In a further preferred embodiment of the invention, it is proposed that from the feed course, an overflow course branches off, in which an overflow valve is disposed and which discharges into the fuel line upstream, in the flow direction of the total fuel flow, of the prefeed pump. The overflow quantity of the overflow valve carries the remaining flow, that is, the quantity of fuel not carried on from the metering unit to the main feed pump, back to the intake side of the prefeed pump.

Advantageously, the metering unit is embodied as a proportional slide valve.

In another preferred embodiment of the invention, the main feed pump is embodied as a high-pressure pump, in particular as a multi-cylinder radial-piston eccentric pump. This kind of radial piston pump has a drive shaft supported rotatably about its longitudinal axis in a housing of the pump. The drive shaft is embodied eccentrically or is provided with camlike protrusions in the circumferential direction. The radial piston pump has a plurality of pump cylinders disposed radially to the drive shaft. Each of the pump cylinders defines one pump chamber, in which a piston is guided to reciprocate. By rotation of the drive shaft, the pistons are moved back and forth into the pump chambers.

The pump assembly of the invention preferably pumps the fuel into a storage volume of a common rail injection system. A common rail injection system is used to supply fuel to internal combustion engines. In contrast to conventional high-pressure injection systems, in which the fuel is pumped to the individual engine combustion chambers via separate lines, in common rail injection systems the injection nozzles are supplied from a common storage volume, which is also called a common rail. Especially in common rail injection systems, the advantages of the pump assembly of the invention are especially valuable, since the production costs for common rail injection systems can be reduced, and the reliability of these injection systems can improved decisively, by the use of the pump assembly of the invention.

In a preferred embodiment of the present invention, the main feed pump and the prefeed pump are combined into an integral pump unit. The pump unit is made to communicate toward the outside with the tank via the fuel line and a return line for the lubricant flow and for venting purposes, and via a high-pressure line, it is made to communicate with the storage volume of the common rail injection system. The requisite connections for the communications with the tank and the storage volume of the common rail injection system can all be made toward the outside on a common flange, where they can be joined especially simply to the corresponding connection lines. The integral pump unit can also be made with an especially small size.

BRIEF DESCRIPTION OF THE DRAWINGS

A preferred exemplary embodiment of the present invention will be explained in further detail below in terms of the drawings. Shown are.

DESCRIPTION OF THE PREFERRED EMBODIMENTS

Figure 1:
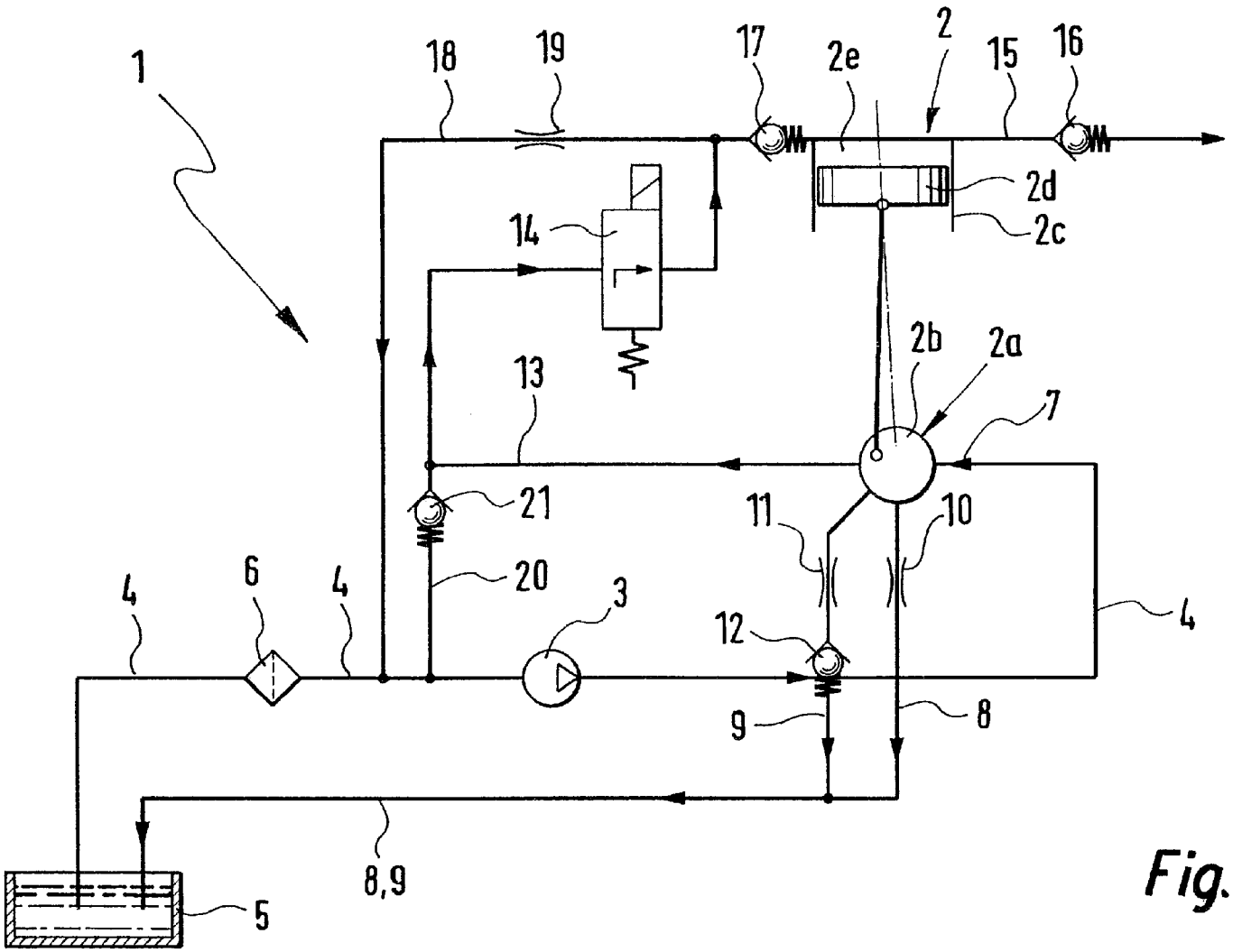
FIG. 1 is a schematic illustration of a pump assembly of the invention, in a preferred embodiment.

The pump assembly shown in FIG. 1 is a pump assembly for a common rail injection system for supplying fuel to gasoline and diesel engines. In contrast to conventional high-pressure injection systems, in which the fuel is pumped via separate lines to the individual combustion chambers of an internal combustion engine, in common rail injection systems the injection nozzles are supplied from a common storage volume, also known as a common rail.

The pump assembly schematically shown in FIG. 1 is identified in its entirety by reference numeral 1. The pump assembly 1 has the main feed pump 2 and a preceding prefeed pump 3. Via a fuel line 4, the prefeed pump 3 pumps fuel out of a tank 5. In the fuel line 4, there is a fuel filter 6, by way of which the fuel pumped by the pump 3 is carried. The total fuel flow pumped by the prefeed pump 3 is pumped through a drive/crank chamber 2*a* of the main feed pump 2. Viewed in the flow direction 7 of the total fuel flow, a return line 9, by way of which a lubricant flow can flow back to the tank 5, and a further return line 8, by way of which a venting flow can flow back to the tank 5, are provided downstream of the drive/crank chamber 2*a*. A venting throttle 10 is disposed in the return line 8, and a throttle 11 and a check valve 12 are disposed in the return line 9. Also downstream of the drive/crank chamber 2*a*, a feed course 13 for a pumping flow to a metering unit 14 and on to the main feed pump 2 is provided. The metering unit 14 is embodied as a proportional slide valve.

The prefeed pump 3 is embodied as a mechanically driven gear pump. The main feed pump 2 is embodied as a high-pressure pump, in particular a multi-cylinder radial-piston eccentric pump. The radial piston pump, shown only symbolically in FIG. 1, includes a drive shaft 2*b*, which is embodied eccentrically or which has camlike protrusions in the circumferential direction (see FIG. 2). The radial piston pump also has a plurality of pump cylinders 2*c*, disposed radially to the drive shaft 2 and each defining one pump chamber 2*e*, only one of which pumps cylinders is shown in FIG. 1. A piston 2*d* is guided in a manner capable of reciprocation in the pump cylinder 2*c*. The pistons 2*d* of the radial piston pump are moved to reciprocate by rotation of the drive shaft 2*b* in the respective pump cylinder 2*c*.

By the reciprocation of the piston 2*d*, the pumping flow is aspirated via a check valve 17 into the pump chamber 2*e* in a so-called intake stroke, and in an ensuing pumping stroke, the fuel located in the pump chamber 2*e* is compressed and pumped, via a high-pressure line 15 in which a check valve 16 is disposed, to a high-pressure storage volume, not shown, of a common rail injection system.

Between the metering unit 14 and the main feed pump 2, a zero-feed course 18 branches off, in which a zero-feed throttle 19 is disposed. The zero-feed course 18 discharges into the fuel line 4 upstream, in the flow direction 7 of the total fuel flow, of the prefeed pump 3, or in other words on the intake side of the prefeed pump 3.

From the feed course 13, an overflow course 20 in which an overflow valve 21 is disposed branches off upstream of the metering unit 14. The overflow course 20 discharges upstream of the prefeed pump in the flow direction 7 of the total fuel flow, that is, on the intake side of the prefeed pump 3, into the fuel line 4.

During the operation of the pump assembly 1 of the invention, the pressure of the overflow valve 21, at the level of approximately 6 bar, is established in the drive/crank chamber 2*a*. The pressure of the overflow valve 21 is selected to be high enough that the lubricant flow through the drive/crank chamber 2*a* of the main feed pump 2 is constant and is sufficiently high to assure good lubrication of the drive shaft 2*b* and good heat dissipation from the drive shaft 2*b*. Furthermore, the pressure of the overflow valve 21 must be selected to be high enough that compulsory lubrication of the slide bearings in the drive/crank chamber 2*a* takes place. In contrast to the pump assembly known from the prior art, in which only the lubricant flow is guided via the drive/crank chamber of the main feed pump, the overflow valve 21 in the pump assembly 1 of the invention replaces the cascade overflow valve used in the pump assemblies known from the prior art, which is substantially more complicated in its design is and correspondingly more expensive.

Figure 2:
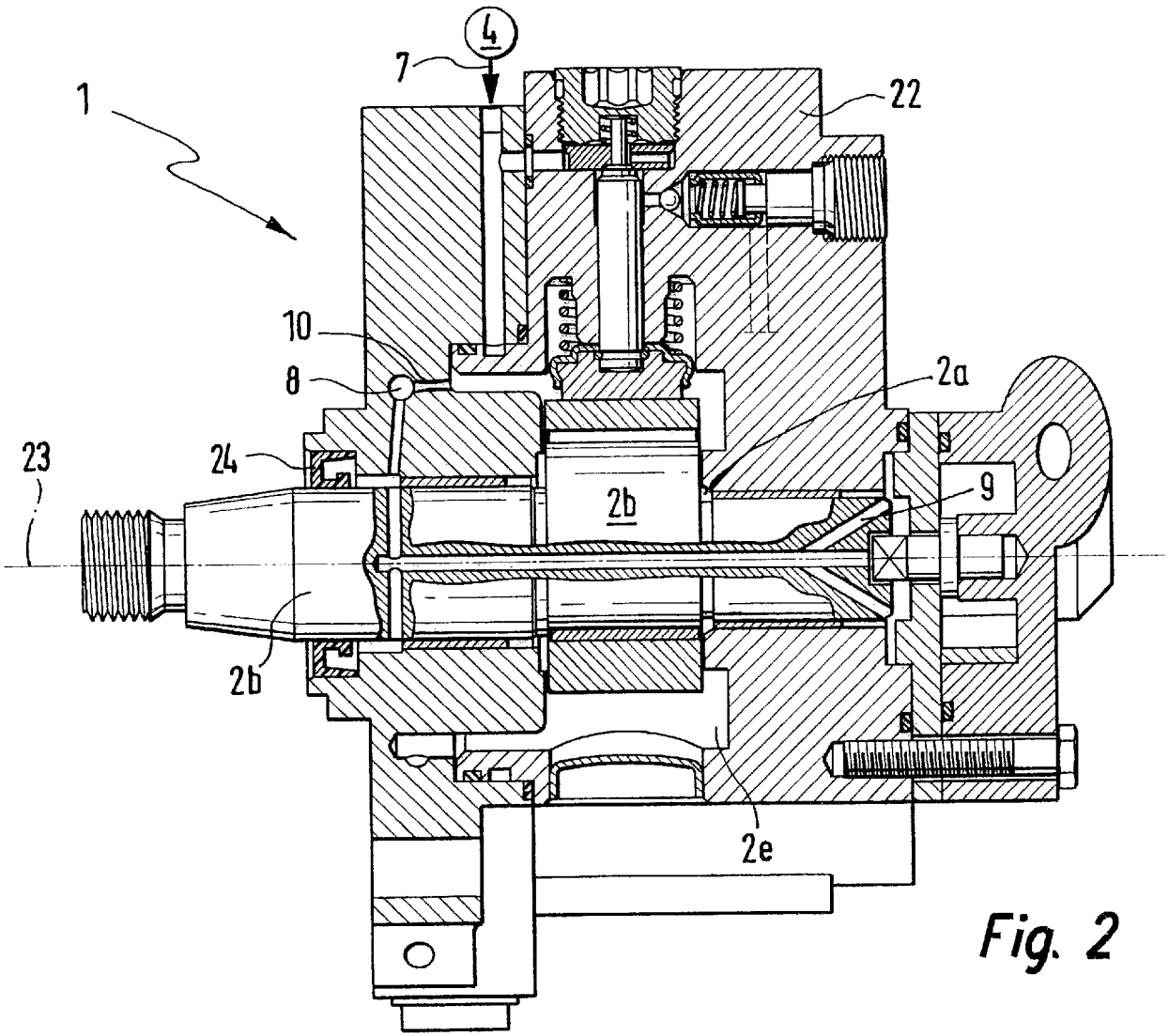
FIG. 2 is a pump assembly of the invention, partly in section.

In FIG. 2, the pump assembly 1 of the invention is shown partly in section. In FIG. 2, components agreeing with those in FIG. 1 are identified by the same reference numerals. The pump assembly 1 has a pump housing 22, in which the main feed pump 2 and the prefeed pump 3 are combined into an integral pump unit. The drive shaft 2*b* of the main feed pump 2 is extended from outside into the pump housing 22. The drive shaft 2*b* rotates about its longitudinal axis 23 in the drive/crank chamber 2*a*, which is embodied in the pump housing 22. The drive/crank chamber 2*a* is sealed off from the outside by a shaft sealing ring 24 toward the pump housing 22. The total fuel flow discharges approximately centrally, in terms of the longitudinal direction of the drive shaft 2*b*, into the drive/crank chamber 2*a*, so that along the way from the orifice into the drive/crank chamber 2*a* until the shaft sealing ring 24, a pressure decrease can take place in the drive/crank chamber 2*a*. This has the advantage that in the pump assembly 1 of the invention, the full pumping pressure is not applied to the shaft sealing ring 24, thus making for especially great durability of the shaft sealing ring 24.

The foregoing relates to preferred exemplary embodiment of the invention, it being understood that other variants and embodiments thereof are possible within the spirit and scope of the invention, the latter being defined by the appended claims.

We claim:

1. A pump assembly (1) for fuel, comprising a main feed pump (2) and a prefeed pump (3), which prefeed pump (3) pumps fuel, via a fuel line (4), out of a tank (5) and into a chamber (2*a*) of the main feed pump (2), a return line (9) downstream of the chamber (2*a*) for fuel to flow as a lubricant back to the tank (5), and a feed course (13) leading to a metering unit (14) and on to the main feed pump (2), said prefeed pump (3) being mechanically driven, and a zero-feed course (18) having a zero-feed throttle (19) therein branching off from the feed course at a point which is between the metering unit (14) and the main feed pump (2), and discharging into the fuel line (4) on the intake side of the prefeed pump (3).

2. The pump assembly (1) of claim 1, wherein said prefeed pump (3) is embodied as a gear pump.

3. The pump assembly (1) of claim 2, further comprising a check valve (12) and a throttle (11) disposed one after the other in the return line (9).

4. The pump assembly (1) of claim 2, further comprising a further return line (8) parallel to the return line (9), said further return line having a venting throttle (10) disposed therein.

5. The pump assembly (1) of claim 4, further comprising an overflow course (20) branching off from the feed course (13) and having an overflow valve (21) disposed therein which discharges into the fuel line (4) upstream, in the flow direction (7) of the total fuel flow, of the prefeed pump (3).

6. The pump assembly (1) of claim 1, further comprising a check valve (12) and a throttle (11) disposed one after the other in the return line (9).

7. The pump assembly (1) of claim 6, further comprising a further return line (8) parallel to the return line (9), said further return line having a venting throttle (10) disposed therein.

8. The pump assembly (1) of claim 7, further comprising an overflow course (20) branching off from the feed course (13) and having an overflow valve (21) disposed therein which discharges into the fuel line (4) upstream, in the flow direction (7) of the total fuel flow, of the prefeed pump (3).

9. The pump assembly (1) of claim 1, further comprising a further return line (8) parallel to the return line (9), said further return line having a venting throttle (10) disposed therein.

10. The pump assembly (1) of claim 9, further comprising an overflow course (20) branching off from the feed course (13) and having an overflow valve (21) disposed therein which discharges into the fuel line (4) upstream, in the flow direction (7) of the total fuel flow, of the prefeed pump (3).

11. The pump assembly (1) of claim 1, wherein said metering unit (14) is embodied as a proportional slide valve.

12. The pump assembly (1) of claim 1, wherein said main feed pump (2) is embodied as a high-pressure pump.

13. The pump assembly (1) of claim 12, wherein said high-pressure pump is embodied as a multi-cylinder radial-piston eccentric pump.

14. The pump assembly (1) of claim 13, wherein said pump assembly (1) pumps the fuel into a storage volume of a common rail injection system.

15. The pump assembly (1) of claim 12, wherein said pump assembly (1) pumps the fuel into a storage volume of a common rail injection system.

16. The pump assembly (1) of claim 1, wherein said main feed pump (2) and said prefeed pump (3) are combined into an integral pump unit.

* * * * *